United States Patent [19]

Block et al.

[11] Patent Number: 5,013,374

[45] Date of Patent: May 7, 1991

[54] PERMANENT DOMAIN REFINEMENT BY ALUMINUM DEPOSITION

[75] Inventors: Wayne F. Block, West Chester; Wade S. Wright, Fairfield, both of Ohio

[73] Assignee: Armco Inc., Middletown, Ohio

[21] Appl. No.: 489,766

[22] Filed: Feb. 28, 1990

Related U.S. Application Data

[63] Continuation of Ser. No. 173,697, Mar. 25, 1988, abandoned.

[51] Int. Cl.[5] ..... H01F 1/02

[52] U.S. Cl. ..... 148/113; 148/122; 204/34; 204/58.5; 204/129.2; 204/181.5

[58] Field of Search ..... 148/111, 112, 113, 122, 148/110; 204/34, 58.5, 129.2, 181.5

[56] References Cited

U.S. PATENT DOCUMENTS

| | | | |
|---|---|---|---|
| 3,990,923 | 11/1976 | Takashina et al. | 148/111 |
| 4,203,784 | 5/1980 | Kuroki et al. | 148/111 |
| 4,236,986 | 12/1980 | Vantini et al. | 204/181.5 |
| 4,698,272 | 10/1987 | Inokuti et al. | 428/627 |
| 4,750,949 | 6/1988 | Kobayashi et al. | 148/111 |

FOREIGN PATENT DOCUMENTS

| | | |
|---|---|---|
| 255926A | 12/1985 | Japan . |
| 2167324 | 5/1986 | United Kingdom . |

OTHER PUBLICATIONS

"Heatproof Domain Refining Method Using Chemically Etched Pits on the Surface of Grain-Oriented 3% Si-Fe", *IEEE Transactions on Magnetics*, vol. MAG-23, No. 5, Sep. 1987, pp. 3062-3064.

*Primary Examiner*—John P. Sheehan

*Attorney, Agent, or Firm*—Larry A. Fillnow; Robert J. Bunyard; Robert H. Johnson

[57] ABSTRACT

The present invention relates to a process for producing permanent domain refinement continuously and at very high line speeds in grain oriented electrical steel having an aluminum nitride inhibitor system. After the final high temperature anneal, the glass film and insulative coating on the surface is removed in narrow bands (grooves or rows of spots). The steel is electroetched to increase the depth of the bands, coated with aluminum by electrophoresis and given a stress relief anneal to bond the aluminum coating to the base metal by diffusion. A localized stress field is induced during cooling which causes domain refinement due to the differential thermal contraction between the aluminum and the base metal.

17 Claims, No Drawings

PERMANENT DOMAIN REFINEMENT BY ALUMINUM DEPOSITION

This is a continuation of copending application Ser. No. 07/173,697 filed on Mar. 25, 1988 now abandoned.

The present invention relates to a method which produces a permanent domain refinement effect in oriented electrical steels using continuous line speeds which are above previous methods. The productivity increases in this process makes this a commercially viable process. Permanent domain refinement is the refinement of magnetic domains capable of surviving a stress relief anneal for improving the magnetic properties.

One of the main factors in electrical steel which must be controlled for optimum core loss properties is eddy-current loss. Some of the factors that influence eddy-current loss are electrical resistivity (e.g. silicon content) stress which causes tension (e.g. surface coatings) and the size of the magnetic domain (e.g. grain size).

During the processing of grain oriented electrical steel to obtain the desired texture, a high temperature final anneal is required to allow the growth of (110) [001] grains at the expense of primary recrystallized grains. Essential to this operation are grain growth inhibitors such as aluminum nitride or manganese sulfide. The secondary recrystallization develops excellent orientation but results in large grain sizes. A larger grain size typically provides a wider domain wall spacing.

To reduce the losses due to magnetic domain size, many attempts have been made to reduce the width of the 180 magnetic domains. Mechanical means to produce grooves or scratches have included shot peening, cutters and knives. High energy irradiation means have included laser beams, electron beams, radio frequency induction or resistance heating. Chemical means to act as grain growth inhibitors have been diffused or impregnated onto the surface prior to the final high temperature anneal. The treatments to produce artificial boundaries to subdivide the domains are typically applied perpendicular to the rolling direction and have a controlled width and spacing between the boundaries.

The domain refinement techniques are generally broken down into two categories. Most of the above systems fall into the first category in which the benefits are erased if given a stress relief anneal. The other category includes permanent domain refinement which survives the stress relief anneal and is sometimes conducted after the final high temperature anneal.

Patents which are typical of domain refinements that won't survive a stress relief anneal include U.S. Pat. Nos. 3,990,923; 4,468,551; 4,545,828 and 4,535,218.

Examples of patents which permanently refine the domain structure after the final high temperature anneal include U.S. Pat. Nos. 4,293,350; 4,363,677; 4,554,029 and 3,647,575.

One of the patents which discusses chemical treatments for domain refinement is the previously mentioned U.S. Pat. No. 3,990,923 which diffuses or impregnates the surface of the steel with a sulfide, oxide, nitride, selenide or antimonide during the final high temperature anneal. A solution or slurry is painted on the strip to prevent secondary recrystallization. Thus, normal grain growth occurs outside the local chemical treatment which prevents the growth of secondary recrystallization into the treated regions. By diffusely injecting a resistant to secondary grain growth, a finer grain size results. The treated regions must be properly spaced to ensure an appropriate degree of recrystallization is attained. The painted bands of annealing separation agent produces lower core losses and higher permeabilities.

One other known patent for chemical treatments to improve the magnetic properties of grain oriented electrical steel is U.S. Pat. No. 4,698,272. This patent teaches the application of a thin coating after the final anneal to the entire surface after the glass has been removed and the surface has been polished. The thin coating of $Al_2O_3$ or TiN was applied by physical vapor deposition or chemical vapor deposition to a thickness of 0.005–2 mm to provide increased tension. Since there is no plastic microstain, the properties are not influenced by a stress relief anneal.

A domain refinement technique that produces supplemental domains which will survive a stress relief anneal at about 1500° F. (815° C.) is very difficult to obtain at existing line speeds used in the production of grain oriented electrical steel. Chemical means have been used for grain growth control during the final anneal and for improved tension to the entire strip. However, chemical means to provide permanent domain refinement which could be applied at commercial line speeds have not been used or suggested by the prior art.

The present invention uses a process which overcomes the problems in providing permanent domain refinement at commercial operating speeds.

It is an object of the present invention to provide a process which can be utilized at commercial line speeds above 300 feet per minute to form localized lines on secondary metal coatings which create regions of stressed base metal.

It is also an object of the present invention to provide a grain oriented electrical steel strip having improved magnetic properties after a stress relief anneal as a result of a localized secondary metal coating in addition to the general secondary coating applied for tension and insulation.

BRIEF SUMMARY OF THE INVENTION

The present invention relates to localized stress by surface alloying to produce permanent domain refinement in grain oriented electrical steel. The electrical steel strip is subjected to a high temperature final anneal and provided with a mill glass on the surfaces of the strip. The strip then has a secondary insulative coating applied to it. Narrow regions of the surface films are removed by means such as a laser, cutting disc, shot peening or the like to expose the base metal beneath the glass. The bands of exposed metal are electrolytically treated to deepen the grooves which are applied perpendicular to the rolling direction. The strip is preferably rinsed and dried.

A metal such as aluminum is deposited into the grooves by flame spraying, slurry coating or electrophoresis. The coating is then flash sintered by means such as induction heating to a temperature of 1200° F. (650° C.) in about 10 seconds or less. The metal deposits resulted in a core loss improvement of 8–12% at B-17 for high permeability grain oriented electrical steel after a stress relief anneal.

DETAILED DESCRIPTION OF THE PREFERRED EMBODIMENT

Grain oriented electrical steels are known to develop large domain wall spacings during the final high temperature anneal. Applying a metal, such as aluminum, in lines modifies this domain spacing by introducing a secondary metal coating after the final high temperature anneal in localized regions where the glass has been removed. The differences in thermal expansion will cause localized stress which reduces domain wall spacing and improves magnetic properties. The improvements in magnetic properties are permanent and will survive a stress relief anneal. The objective of the present invention is to apply this technology at commercial line speeds.

The starting material of the present invention may be regular grain oriented electrical steel or high permeability grain oriented electrical steel. The steels may contain up to 6.5% silicon although a range of 2.8 to 3.5% silicon is generally employed. The steels may contain additions of manganese, sulfur, selenium, antimony, aluminum, nitrogen, carbon, boron, tungsten, molybdenum, copper or the like in various well known combinations to provide the metallurgical means to control grain size and texture. The melt composition for the steels evaluated had the following composition in weight percent:

| | |
|---|---|
| Carbon | 0.055% |
| Manganese | 0.085% |
| Sulfur | 0.025% |
| Silicon | 2.97% |
| Aluminum | 0.031% |
| Nitrogen | 0.007% |
| Tin | 0.045% |
| Iron | Balance |

The electrical steel is fabricated into cold rolled strip by any of the well known processes and provided with a decarburizing anneal if needed prior to the final high temperature anneal. The strip is subjected to a final high temperature and provided with a glass film on the strip surfaces and a secondary insulative coating is applied.

According to the present invention, the glass film must be removed in narrow regions spaced about 5 to about 10 mm apart. The locally treated regions could be produced using any of scribing means listed in the domain refinement patents previously which cause surface removal. The selection of a laser, shot peening or scratching means is based on the line speed limitations to accomplish the removal of the glass. For an in-line operation, the process requires a short treatment time and a laser is the preferred choice. The laser could be a continuous wave, pulsed or Q-switched to deliver the energy required to remove the glass in a short dwell time. U.S. Pat. No. 4,468,551 discusses the various laser parameters which control the depth of penetration and energy per unit area. The patent teaches the level at which coating damage occurs and can be controlled by selecting the proper power, dwell time and beam shape. For an insulative coating such as taught in U.S. Pat. No. 3,996,073, the laser energy per unit of vertical area is multiplied by a constant related to the thermal diffusivity (about 0.48 for silicon steel) and should exceed a value of about 40 for coating degradation. The coating removal may be in the form of a groove or row of spots and should have a width (or spot diameter) of about 0.05 to 3 mm and a depth of about 0.0025 to 0.0125 mm. Obviously these values are related to the thickness of the mill glass surface.

The $CO_2$ laser was selected for removing the glass and deepening the grooves or spots. However, the thermal effect from the laser caused the samples to curl. A significant amount of molten metal was splattered around the ridges. The laser must be controlled to remove the glass and expose the base for electroetching to develop the desired depths for the secondary metal coating. The following $CO_2$ laser conditions were used for a laboratory trial:

| | |
|---|---|
| Focal Length | pulse |
| Pulse Rate | 5 inches (12.7 cm) |
| Pulse Width | 139–1000 pulses/second |
| Average Power | 100–420 watts |
| Spot Spacing | 0.025–0.06 inches (0.63–1.5 mm) |
| Spot Diameter | 0.01–0.014 inches (0.25–0.35 mm) |
| Line Speed | 40 feet/minute (12 meters/minute) |

The desired groove (or spot) depth is preferably obtained using a 2-stage process. Once the glass surface is removed in the localized regions, an electrolyte process is used to obtain the desired depth. This process is covered by a copending application filed in the name of W. F. Block and assigned to the assignee of the present invention.

Electroetching enables the base metal to be removed rapidly and avoids the damage caused by other processes. Other means to generate the same groove will cause ridges around the groove (or spots) and cause base metal splatter during the removal process to be deposited on the glass film. The localized thinning by electroetching increased the depth up to about 0.025 mm.

The electrolytic etch preferably uses a nitric acid of 5–15% concentration in water or methanol to etch the groove in less than about 10 seconds. Preferably water at a temperature of about 65° C.–80° C. is used to increase the rate of etching. A current of 0.5–1.0 amp/cm$^2$ of exposed base metal in the scribe line region. The strip is then rinsed with water and dried prior to depositing a secondary metal coating.

The metal deposit must be applied using a process which confines the metal to the grooves or rows of spots where the surface films have been removed on the strip.

One technique which was studied was to apply aluminum rapidly by flame spraying. The magnetic results of flame spraying aluminum onto 0.23 mm samples of high permeability grain oriented electrical steel are reported in Table 1. The samples were masked to leave 1 mm wide lines, spaced 10 mm apart, exposed for coating. An argon-hydrogen atmosphere was used. The samples were given a stress relief anneal at 1500° F. (815° C.) and tested for magnetic properties and domain refinement. The results indicated that diffusion and alloying did occur during the anneal which resulted in domain refinement. However, the large drop in permeability indicated the size of the deposit was too great. Smaller deposits should result in greater improvement. Also, further consideration of the flame spray method showed that directing the aluminum to well defined areas of the strip could not be accomplished rapidly enough for commercial feasibility.

TABLE 1

| Line Speed Limitation | | | | | | | |
|---|---|---|---|---|---|---|---|
| Initial Quality | | | Quality As-Sprayed and SRA'd | | | % Improvement (Deterioration) | |
| B15 (w/lb) | B17 (w/lb) | H-10 | B15 (w/lb) | B17 (w/lb) | H-10 | B15 | B17 |
| .398 | .534 | 1939 | .388 | .528 | 1914 | 2.5 | 1.1 |
| .405 | .566 | 1960 | .384 | .541 | 1905 | 7.5 | 4.4 |
| .388 | .527 | 1935 | .387 | .530 | 1902 | 0.3 | (0.6) |
| .384 | .536 | 1927 | .371 | .507 | 1876 | 3.4 | 5.4 |
| .386 | .537 | 1921 | .389 | .529 | 1865 | 0 | 1.5 |
| .382 | .531 | 1925 | .373 | .513 | 1884 | 2.4 | 3.4 |
| .381 | .554 | 1931 | .367 | .502 | 1886 | 3.7 | 9.4 |
| .392 | .535 | 1928 | .377 | .514 | 1854 | 3.8 | 3.9 |

A second technique considered for rapid aluminum deposition was slurry coating. The magnetic results of slurry deposition are shown in Table 2. Similar samples were masked to give different deposit thicknesses and a range of line spacings.

A slurry of 12% polyvinylacetate in water and 1 gm/ml aluminum was used for coating. Only one side was coated onto the masked samples. The coating was cured in air at 200° F. (95° C.) for 5 minutes. After curing, the samples were stress relief annealed at 1500° F. (815° F.) and tested for magnetic properties and domain refinement. The thinner deposits clearly provided the greatest core loss improvements. The deposits were clearly smaller than with flame spraying. The results indicate the process can provide improvements in magnetic properties equivalent to laser irradiation and the benefits would survive stress relief annealing. However, similar limitations in commercial feasibility resulted. Masking was a necessary part in correctly locating the lines of aluminum deposit. This technique would be undesirable for in-line processing.

TABLE 2

| Aluminum Slurry Coating | | | | | | | | | |
|---|---|---|---|---|---|---|---|---|---|
| Initial Quality | | | Quality As-coated and SRA'd | | | Deposit Line | | | |
| B15 (w/lb) | B17 (w/lb) | H-10 | B15 (w/lb) | B17 (w/lb) | H-10 (mm) | Height (mm) | Spacing (mm) | % Improvement B15 | B17 |
| .421 | .574 | 1945 | .372 | .490 | 1947 | .012 | 11 | 11.6 | 14.6 |
| .400 | .548 | 1938 | .372 | .494 | 1931 | .012 | 11 | 7.0 | 10.0 |
| .400 | .544 | 1936 | .394 | .524 | 1909 | .050 | 11 | 1.5 | 3.7 |
| .391 | .522 | 1944 | .379 | .499 | 1920 | .050 | 11 | 3.4 | 6.3 |

A third technique was tried based on an electrophoretic coating which is deposited by an electric discharge of particles from a colloidal solution onto a conductive substrate. In this case, however, the goal was to only coat the aluminum powder onto lines running perpendicular to the rolling direction and spaced approximately 6 mm apart. The magnetic results from electrophoretic deposition are given in Table 3. The bath composition which appears to provide the best control for aluminum deposition has the following conditions:

| | |
|---|---|
| Bath | methanol; 0.25 gm/l AlCl3; .035 gm/l Tannic Acid |
| Powder | atomized aluminum |
| Temperature | room temperature |
| Agitation | sufficient to suspend particles |
| Voltage | 0.1 volts (dc)/cm of scribe line |

The samples prior to deposition were the same as the previous studies. During deposition, electrical contact was made at the edge of the sample. The samples were dried in heated air to remove the methanol and then subjected to a stress relief anneal. Testing for magnetic properties and domain refinement was then conducted. The results indicate the process generates a substantial quality improvement, survives a stress relief anneal and may be accomplished within 10 seconds which makes it a commercially attractive process for use with existing line speeds. The process is further optimized when the aluminum deposit does not form a ridge. Deeper grooves would alleviate this problem which adversely influences the stacking factor and surface resistivity.

TABLE 3

| Electrophoretic Deposition of Aluminum | | | | | | | | |
|---|---|---|---|---|---|---|---|---|
| Initial Quality | | | Quality Deposited and SRA'd | | | Deposit Size | % Improvement (Deterioration) | |
| B15 (w/lb) | B17 (w/lb) | H-10 | B15 (w/lb) | B17 (w/lb) | H-10 (mm) | Wt./Scribe Line (mgm/cm) | B15 | B17 |
| .397 | .534 | 1929 | .387 | .517 | 1925 | 12 | 2.5 | 3.2 |
| .392 | .527 | 1926 | .391 | .518 | 1922 | 13 | 0.0 | 1.7 |
| .399 | .531 | 1928 | .387 | .513 | 1922 | 27 | 3.0 | 3.4 |
| .397 | .540 | 1937 | .376 | .500 | 1931 | 36 | 5.3 | 7.4 |
| .401 | .535 | 1926 | .371 | .493 | 1926 | 37 | 7.5 | 7.8 |
| .404 | .545 | 1929 | .360 | .480 | 1918 | 53 | 10.9 | 11.9 |
| .378 | .511 | 1926 | .347 | .464 | 1904 | 78 | 8.2 | 9.2 |

The beneficial effect of aluminum deposition by electrophoresis on magnetic quality has been determined. The processing requires a means to remove the glass film and provide scribed regions where the aluminum may be deposited for permanent domain refinement. To be commercially attractive, the combination of laser scribing, electroetching and electrophoretic deposition of aluminum appears to have the highest line speed capabilities. As other techniques to remove the glass film, or prevent its formation, are developed, the benefits from this type of metal coating for permanent domain refinement would still exist.

It will be understood that various modifications may be made to the invention without departing from the spirit and scope of it. The embodiments of the invention in which an exclusive property or privilege is claimed are defined as follows in the appended claims.

We claim:

1. A continuous high-speed process for producing permanent domain refinement in grain oriented electrical steel strip having a glass film, said process comprising:

(a) removing said glass film in narrow regions about 0.0025 to about 0.0125 mm deep, about 0.05 to 0.3 mm wide about 4 to about 10 mm apart, said regions being substantially perpendicular to the rolling direction of said strip;

(b) depositing by electrophoresis an aluminum coating into said regions;

(c) bonding the aluminum coating to the steel strip by heating the aluminum coated steel strip;

(d) subsequent cooling causing localized stress to develope in the aluminum coated steel strip as the result of differential thermal contraction between the aluminum coating and the electrical steel, said localized stress causing magnetic domain refinement in the electrical steel strip.

2. The process of claim 1 wherein the glass film is removed using a laser and the regions deepened using an electrolytic etch.

3. The process of claim 1 wherein the grain oriented electrical steel uses an aluminum nitride inhibitor system.

4. The process of claim 1 wherein the coating material is heated by induction to bond said coating.

5. The process of claim 3 wherein said aluminum coating is provided using an electrophoretic bath containing:

(a) up to 10 grams of aluminum powder per liter of methanol, (b) 20 to 50 milligrams of aluminum chloride per liter of methanol, and (c) 20 to 50 milligrams of tannic acid per liter of methanol, said strip being subjected to a voltage of 30 to 50 volts for 5 to 15 seconds to electrophoretically deposit said aluminum coating in said regions.

6. The process of claim 2 wherein said electrolytic etch is conducted in a water bath at 65° C. to 80° C. containing 5 to 15% nitric acid and uses a current of 25–75 milliamps per cm of region length.

7. The process of claim 1 wherein said strip is rinsed with water and dried after said regions of no glass film are formed.

8. A high speed method for producing permanent domain refinement in coated grain oriented electrical steel strip after the final high temperature anneal, said method comprising:

(a) scribing said strip after said final anneal to remove said glass coating and expose said electrical steel said exposed steel being in narrow regions about 0.0025 to about 0.0125 mm deep, about 0.05 to 0.03 mm wide, and spaced about 4 to about 10 mm apart, said regions being substantially perpendicular to said strip's rolling direction;

(b) electrophoretically depositing aluminum into said scribed regions;

(c) bonding the aluminum cooling to the steel strip by heating the aluminum coated steel strip;

(d) subsequent cooling causing localized stress to develope in the aluminum coated steel strip as the result of differential thermal contraction between the aluminum coating and the electrical steel, said localized stress causing magnetic domain refinement in the electrical steel strip.

9. The method of claim 8 wherein said steel is exposed in said narrow regions by laser scribing to remove said coating and electroetching to control said depth for optimum magnetic properties.

10. The method of claim 8 wherein said electrophoretic deposition of aluminum is provided by a bath containing:

(a) up to 10 grams of aluminum powder per liter of methanol;

(b) 20 to 50 milligrams of aluminum chloride per liter of methanol; and (c) 20 to 50 milligrams of tannic acid per liter of methanol, said strip being subjected to a voltage of 30 to 50 volts to electrophoretically apply said aluminum.

11. A high speed method for producing permanent domain refinement in grain oriented electrical steel strip after the final high temperature anneal, said strip having a glass coating with narrow regions of exposed base metal spaced about 4 to about 10 mm apart, about 0.05 to 0.03 mm wide and about 0.0025 to about 0.0125 mm deep, said regions being substantially perpendicular to said strip's rolling direction, the improvement comprising:

(a) depositing an aluminum coating by electrophoresis into said regions of exposed base metal;

(b) bonding the aluminum coating to the steel strip by heating the aluminum coated steel strip;

(c) subsequent cooling causing localized stress to develope in the aluminum coated steel strip as the result of differential thermal contraction between the aluminum coating and the electrical steel, said localized stress causing domain refinement in the electrical steel strip.

12. The process of claim 11 wherein said electrophoresis coating is provided by a bath containing:

(a) up to 10 grams of aluminum powder per liter of methanol;

(b) 20 to 50 milligrams of aluminum chloride per liter of methanol; and (c) 20 to 50 milligrams of tannic acid per liter of methanol.

13. The process of claim 11 wherein said electrophoresis coating is deposited using 30 to 50 volts for 5 to 15 seconds.

14. The process of claim 11 wherein said grain oriented electrical steel has an aluminum nitride inhibitor system.

15. The process of claim 11 wherein said strip is heated by induction to bond said aluminum coating.

16. A high speed process for producing permanent domain refinement in grain oriented electrical steel having a glass coating after the final temperature anneal, said process comprising:

(a) subjecting said strip to a laser at spaced regions which are perpendicular to the rolling direction to remove said glass coating and expose said electrical steel;

(b) electrolytically etching said regions of exposed base metal in a nitric acid bath having 5 to 15% nitric acid, the balance chosen from the group of water and methanol, said bath being from 65° to 80° C., said etching being accomplished in less than about 10 seconds using a current of 0.5–1.0 amps per square centimeter of exposed base metal;

(c) depositing an aluminum coating by electrophoresis into said exposed regions;

(d) bonding the aluminum coating to the steel strip by heating the aluminum coated steel strip;

(e) subsequent cooling causing localized stress to develope in the aluminum coated steel strip as the result of differential thermal contraction between the aluminum coating and the electrical steel, said localized stress causing magnetic domain refinement in the electrical steel strip.

17. The process of claim 16 wherein said strip is rinsed with water and dried after said electroetching is complete.

* * * * *